United States Patent [19]

Silverbush et al.

[11] 4,007,537

[45] Feb. 15, 1977

[54] METHOD OF REGISTERING LOGO CARRYING FASTENER PRIOR TO EMPLACEMENT ON GARMENT

[75] Inventors: Herbert M. Silverbush, Providence, R.I.; Philip B. Jensen, Seekonk, Mass.

[73] Assignee: Rau Fastener, a division of U.S. Industries, Inc., Providence, R.I.

[22] Filed: Aug. 20, 1975

[21] Appl. No.: 606,076

Related U.S. Application Data

[62] Division of Ser. No. 529,689, Dec. 5, 1974, abandoned.

[52] U.S. Cl. ..... 29/432.1; 29/771; 29/809; 29/407; 198/394; 227/119

[51] Int. Cl.[2] ..... B23P 11/00

[58] Field of Search ..... 29/432, 432.1, 407, 29/200 B, 200 R, 200 P, 208 R, 208 C, 208 D, 211 R, 211 D; 227/116, 118, 119; 198/257, 261

[56] References Cited

UNITED STATES PATENTS

| | | | |
|---|---|---|---|
| 2,265,574 | 12/1941 | Peterson | 198/257 |
| 2,588,486 | 3/1952 | Clarke | 227/119 X |
| 3,192,844 | 7/1965 | Szasz et al. | 29/200 P X |
| 3,400,442 | 9/1968 | Morris | 198/257 X |
| 3,601,881 | 8/1971 | Seidewitz | 29/208 R |
| 3,616,985 | 11/1971 | Koch | 29/208 D X |
| 3,750,925 | 8/1973 | Schmidt et al. | 227/18 |
| 3,815,805 | 6/1974 | Beneteau | 227/116 X |

*Primary Examiner*—Victor A. DiPalma
*Attorney, Agent, or Firm*—Arthur L. Plevy

[57] ABSTRACT

A registration system is adapted to operate with a conventional snap fastener attachment machine and serves to position a fastener having a logo imprinted on a surface in any one of a plurality of desired positions to assure that the fastener, when emplaced on the garment, will be positioned to enable correct orientation of the logo. The fastener is associated with a notch, which notch is coated by one of a plurality of finger members associated with the registration system. The coaction of the notch by the finger member serves to terminate rotation of the fastener and further serves to indicate to the operator that orientation is correct. The finger members can be selected according to the nature or configuration of the garment to permit a single fastening machine to accomplish fastener attachment and automatic orientation of the same.

9 Claims, 15 Drawing Figures

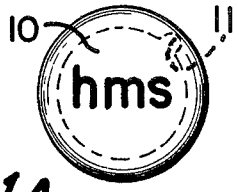
Fig. 1A.
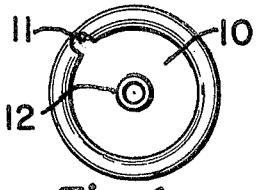
Fig. 1B.
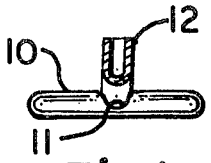
Fig. 1c.
Fig. 2A.
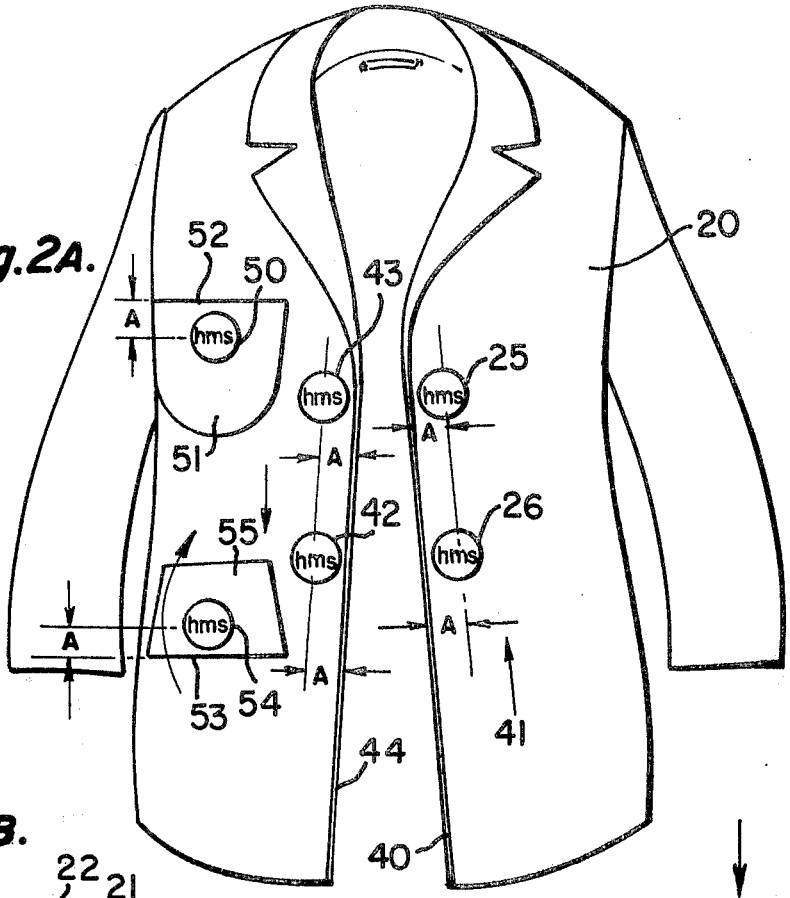
Fig. 2B.
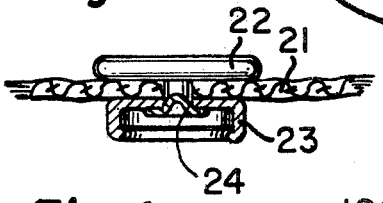
Fig. 3.
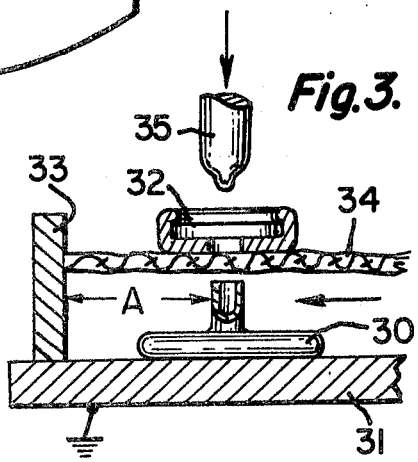
Fig. 4A.
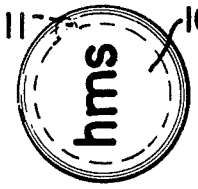
Fig. 4C.
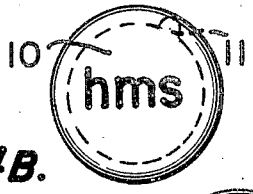
Fig. 4B.
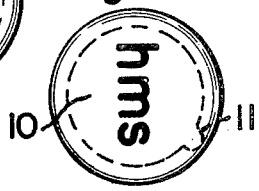
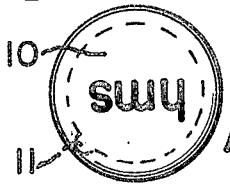
Fig. 4D.

METHOD OF REGISTERING LOGO CARRYING FASTENER PRIOR TO EMPLACEMENT ON GARMENT

This is a divisional of application Ser. No. 529,689 filed on Dec. 5, 1974 and now abandoned.

BACKGROUND OF INVENTION

This invention relates to snap fastener attaching machines in general, and more particularly to a fastener registration system employed in conjunction with such machines.

Snap fasteners are widely used on a great variety of garments as men's, women's and children's clothing of all sorts and types.

Such fasteners conventionally consist of a female part and a male mating part. As such, the fastener is used in lieu of conventional buttons or zippers and has great utility and advantages in the production and manufacture of such garments. Associated with the desireable functional features of snap fasteners are other aesthetic considerations. Since a fastener is usually fabricated from a metal, such as stainless steel or brass, or from a hard plastic, and since the surface of the fastener which is exposed to view after attachment to the garment, is usually fabricated to present an appealing view; many manufacturers desire that their trademark or logo be imprinted or stamped on the exposed surface of the fastener. This enables a consumer to quickly identify the product and to further give the clothing manufacturer additional exposure, since the trademark is readily viewable when the garment is worn by a user.

As such, the manufacturer desires that when the fastener be placed on the garment, it is positioned in such a manner as to enable one to readily view the logo or trademark in the correct orientation; with respect to the manner in which the garment is worn or displayed.

Such fasteners are automatically positioned on garments by means of a well-known machine commonly indicated as a snap fastener attaching machine.

The garment to which such fasteners are to be attached is directed through the machine by an operator. The operator, by activating a switch or foot pedal causes a fastener assembly to be secured on the garment at a desired location. The automatic fastener machine serves to direct fastener parts from suitable hoppers and aligns them one above the other. Upon depression of the switch or foot pedal, the machine then performs an attaching operation or a riveting operation securing the fastener to the garment.

The mechanisms and operation of such snap fastener attaching machines are well known. Many manufacturers including the assignee herein, provide and have provided such equipment for many years.

In any event, when a fastener is associated with a logo or trademark which must be oriented with the garment so that the name or mark can be read by a consumer or another person, it presents a problem.

Namely, the portion of the fastener that is exposed to view after attachment to the garment is usually circular in shape or shaped uniformly. The prior art machines only serve to assure that the component parts of the fasteners are directed above and below the garment when the same is inserted within the confines of the machine so that a fastener can be secured. The machine cannot and does not register the fastener properly in regard to the logo without additional apparatus.

The technique for the proper alignment of such fasteners is referred to as registration and the prior art shows a number of various apparatus which serve to orient an article or a button in a desired manner with respect to a predetermined reference point. Such orientation devices may fall in the category encompassed by Class 156 involving label printing and attachment apparatus, Class 116, subclass 136.5 involving alignment techniques and Class 198.

In any event, the registration of snap fasteners poses many unique problems not usually associated with conventional alignment techniques.

For example, a basic difference in the fabrication of men's and women's clothing is that the respective garments are secured, fastened or buttoned on opposite sides.

Thus, if one employed a registration system which would properly align a logo or a writing in regard to the emplacement of a fastener on a man's shirt, for example, one might direct the shirt through the machine from left to right with the collar side passing through first. Now if one desired to emplace a fastener on a women's blouse by using the same machine, the logo would appear upside down, since the women's blouse would have to be directed with the shirt tail portion passing through first.

Hence, the prior art would use one fastener front for men's garments and one for women's. This is, of course, expensive and uneconomical. Furthermore, fasteners must be attached to pockets or flaps associated with garments. The attachment is made prior to securing the flap or pocket to the garment. Since the top edge of the pocket is usually inserted in the fastener machine, the logo would be misorientated ninety degrees by such a machine.

Essentially, many garment sections which require fastener attachment due to the shape or configuration of the same, would require a number of different registration angles to assure that the logo will be properly orientated on the garment.

Inherent in such operations is the further consideration that the operation or registration must be automatic to maintain efficient and reliable production capability. The operation of registration must be positive and reliable to prevent the wasting of products and it must be relatively divorced from operator discretion.

It is therefore an object of the present invention to provide a registration apparatus capable of registering a logo associated with a fastener in any one of a plurality of positions depending upon the type or portion of the garment to which a fastener is to be emplaced; while further providing an efficient and reliable operation using a single snap fastener attaching machine.

BRIEF DESCRIPTION OF PREFERRED EMBODIMENT

Registration apparatus to be used in conjunction with an automatic fastener attaching machine serves to orient the fastener having a logo-bearing front surface in one of a plurality of desired orientations, to enable emplacement of said fasteners on a surface to assure that said logo is properly viewed when emplaced on said surface comprising; indicator means located on a surface of said fastener and indicative of the emplacement of said logo thereon, a plurality of selectable projections located with respect to a fastener accommodating area and positioned such that any one of said selectable projections can be extended into the confines of said area, means for rotating said fastener at a relatively high rate to cause said selected one of said projections to coact with said indicator means on said surface of said fasteners when said fastener attempts to rotate past said extended projection; whereby said fastener can be positioned by any of said selectable projections thereby specifying a plurality of desired orientations, and means responsive to the restraining of said fastener to emplace the same in said selected orientation on said surface.

BRIEF DESCRIPTION OF FIGURES

FIGS. 1A to 1C are front, rear and side elevational views of a fastener used in conjunction with this invention.

FIG. 2A is a front view of a sample garment useful in explaining registration.

FIG. 2B is a side view of an emplaced fastener.

FIG. 3 is a sample diagram depicting a fastener emplacement operation performed by a conventional attaching machine.

FIGS. 4A to 4D show four various orientation configurations for fasteners bearing logo which has to be properly oriented with respect to the garment shown in FIG. 2A.

DETAILED DESCRIPTION OF FIGURES

Figure 5A:
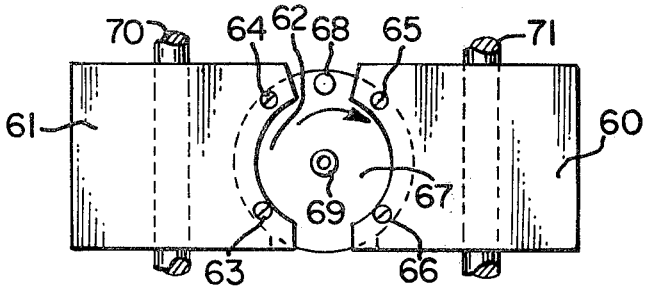
FIG. 5A is a top elevational view of a pair of jaws used in conjunction with the invention.

Before proceeding with a description of the apparatus used in performing registration, a clearer description of the problem to be solved is believed to be warranted.

Referring to FIG. 1A, there is shown a top view of a fastener 10 including the arbitrary initials HMS. It being understood that the surface shown of the fastener 10 may have imprinted thereon any other logo, name or trademark relating to a particular entity.

The top surface of the fastener 10 is that portion which will be exposed to view when the fastener 10 is secured to a garment. Conventionally, such fastener as 10 may be fabricated from steel or brass or some other attractive, non-corrosive metal or may be fabricated from a plastic. The logo may be stamped, painted, or in some other manner impressed on the surface 10. Shown in dashed lines is a notch 11, which is fixed with respect to the logo and located on the bottom surface of the fastener 10. The notch 11 as positioned, is oriented during the logo stamping process or during the fastener 10 fabrication and is permanently positioned with respect to the logo as shown. Thus, the notch 11 location is indicative of the orientation of the logo on the fastener 10. As seen in FIG. 1A, the notch 11 is located above and to the right of the letter S in the initials HMS. It is of course, understood and will be seen, that the notch 11 can occupy a number of alternate positions, each of which will specify the logo orientation as above indicated.

FIG. 1B shows a bottom view of the fastener 10. Conventionally, the fastener unit 10 is fabricated by a stamping process. The fastener has a shank portion 12 which is used to retain a female counterpart necessary to secure a fastener assembly to a garment, as will be explained.

FIG. 1C is a side view of the fastener 10 showing the shank portion 12 in clearer detail. While such fasteners as 10 are composite members, the nature of the device or the fabrication of the fastener 10 is not necessary to the understanding of the invention.

However, it is important to note that the fastener 10 as containing the logo on the top surface includes a notch 11 or other indexing means on a surface thereof, which is indicative of the orientation of the logo.

Referring to FIG. 2A, there is shown a garment 20 with a number of fasteners as 10 of FIG. 1A secured thereto. It is understood that the garment 20 is shown only by way of example and to further clarify the problem of registration of the logo. As indicated, the garment 20 has a number of fasteners secured thereto with the initials HMS all oriented correctly for display presentation purposes and so on as described above.

As is known, a garment as 20 comprises a number of sections which are sewn or fastened together during an assembly procedure.

A distance A is shown on the diagram and represents the distance from an edge of a garment section at which point, a fastener is to be secured to the garment.

FIG. 2B shows a cross sectional view taken through a fastener secured to a garment by an automatic fastener machine.

As such, the material 21 is located between the male member 22 (corresponding to 10 of FIG. 1A) and a female or socket member 23. The member 22 has a shank 24 as shank 12 of FIG. 1C. This shank is forced through the material 21 by the automatic machine into a hole or aperture of the socket 23. The fastening machine then rivets, bends or fractures the shaft 24 so that the sides are forced against the corresponding surface of the female socket 23 to retain the assembly to the garment 21 as shown.

This is conventional in most fastener securing machines. The top surface of member 22 is that surface upon which the logo appears.

The operation which accomplishes the emplacement of the fastener as shown in FIG. 2B is a punching or riveting operation and is performed by the insertion of the edge of the garment between an upper and lower punch assembly associated with a conventional fastener attaching machine.

A simple schematic of such an operation is shown in FIG. 3, for example.

The fastener machine without registration places a logo bearing member in a predetermined position on a reference plane or table top as 31. Simultaneously, a socket member as 32 is positioned in congruency with and above or below the member 30. An operator inserts the edge of the garment 34 into the space between the member 30 and 32. The distance A or the depth to which the garment is inserted is determined by a gauge bar or stop member 33. The member 33 is adjustable and may be positioned to permit an edge of a garment 34 to be inserted in the apparatus, the desired distance A, which can vary from ⅛ to 1 inch or more, dependent upon the garment, the diameter of the fastener and so on.

When the garment 34 is inserted as shown, a punch or die member 35 is brought down forcing the shank of member 30 through the material of the garment 34 and distorts the shank to secure the assembly to the material as shown in FIG. 2B. It is understood that the positioning of the members as 30 and 32 and the automatic feeding of the members as well as the operation and activation of the punch or die member as 35, are well known in the art and a plurality of such machines exist to do so.

An example of a prior art fastening machine which will perform the above noted operation is manufactured by RAU FASTENER, a Division of U.S. Industries Company of Rhode Island and designated as the Model 6N snap fastener attaching machine. Other manufacturers produce similar operating machines as SCOVILL MANUFACTURING and UNITED CAR COMPANY.

In any event, the operation is known and widely used. It can be seen that there is no registration provided in the apparatus shown in FIG. 3 and therefore the member 30, having a logo bearing surface, can be secured in any orientation on the garment without regard or registration of the logo in the final product, such as the garment 20 shown in FIG. 2A.

The above technique being described assumes one would desire to secure fasteners 25 and 26 to the garment 20 of FIG. 2A and assures that the logo is oriented as shown.

The operator would insert the edge 40 into the space between the members as 30 and 32 (FIG. 3) and move the garment from the position occupied by fastener 26 to that of fastener 25 and hence, perform two emplacements. The arrow 41 indicates the direction of the motion.

FIGS. 4A to 4D show four different fastener orientations for the logo HMS.

To properly emplace the fasteners as 26 and 25 for the movement shown by arrow 41, one would need the fasteners member configuration shown in FIG. 4B to achieve the orientation shown for fasteners 25 and 26.

Now, if one wished to emplace fasteners 42 and 43 on the garment, one would have to insert edge 44 into the apparatus at the distance of A again.

To emplace the buttons 42 and 43, one would have to move the garment through the machine in the opposite direction of arrow 41 and select the registration shown in FIG. 4A.

It can be seen that since the notch (as 11 of FIG. 1A) is always predetermined, i.e. closest to the "S" of the initials; it will be furtherest from the edge 40 of garment 20 for fasteners 25 and 26, and closest to the edge 44 for fasteners 42 and 43.

Now assume one wished to emplace a fastener 50 on a pocket portion 51 of the garment 20. As indicated, the pocket 51 containing the fastener 50 would later be secured or sewn to the garment 20.

Edge 52 would be the edge inserted to position the fastener 50 as shown. One would therefore require the orientation shown in FIG. 4C to accomplish this.

Accordingly to emplace the fastener 54 on a pocket flap 55, one would insert the edge 53 into the machine and hence would require the orientation shown in FIG. 4D.

While FIG. 4 shows four orientations or registrations desired, it will be noted that many other possibilities exist, all of which can be accommodated by the registration system to be explained.

Referring to FIG. 5, the registration system employed will be explained in operation.

FIG. 5A depicts a pair of jaws having a right side jaw member 60 and a left side jaw member 61.

Each jaw member as 60 and 61 has a front portion which includes a semi-circular groove as 62. There are located on the jaws two set screw locations.

The locations of the set screws are indicated as 63 and 64 for jaw 61 and as 65 and 66 for jaw 60.

A fastener cover or front member 67 is positioned by the automatic fastener machine beneath the jaws, as shown. The fastener member 67 is substantially that member described in conjunction with FIG. 1 and has an aperture 68 located on the bottom surface thereof (as aperture or groove 11 of FIG. 1).

An arrow is drawn about the shaft 69 associated with the fastener member 67 to indicate that it is rotated. Even though the arrow is shown in a clockwise direction, it is understood that counter clockwise rotation could be employed as well.

Each set screw as 63 to 66 can be advanced to protrude beneath the bottom surface of the associated jaw 60 and 61. The protuding end of a set screw is a finger-like projection which, as will be explained, coacts with the groove 68 associated with the fastener 67.

Figure 5B:
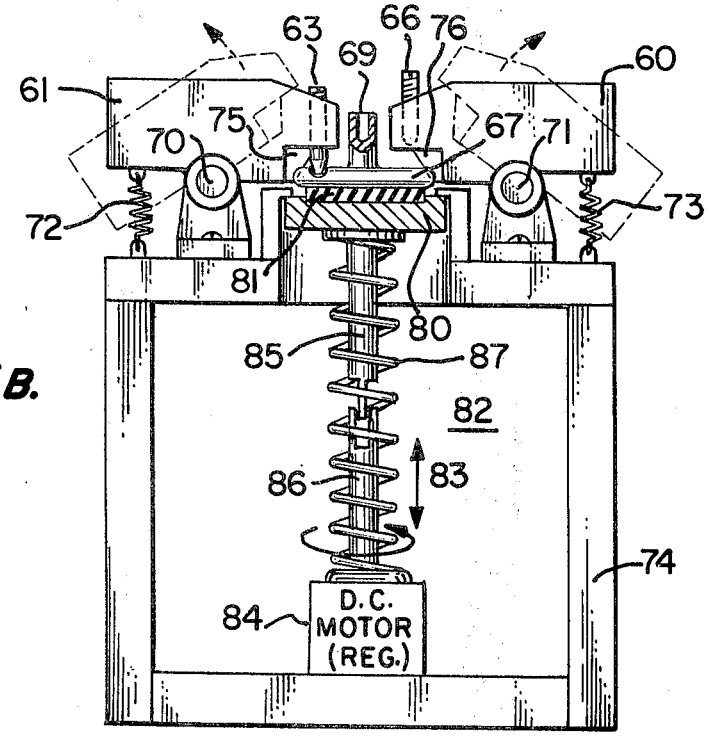
FIG. 5B is a side elevational view of a registration apparatus according to the invention.

Referring to FIG. 5B, a side elevational view of the registration mechanism is shown.

Each jaw as 60 and 61 is mounted on the automatic fastener machine table as 31 of FIG. 3. The jaws are mounted by means of a pivotable coupled or fulcrum arrangement at one end as 70 for jaw 61 and 71 for jaw 60. This permits the jaws to move or pivot in the directions shown by the arrows. The jaws are biased by means of springs 72 and 73 to bias the jaws 60 and 61 so that they are normally drawn towards the table surface 74 of the fastener machine.

Each jaw as 60 and 61 has an abutting surface as 75 and 76, rigidly fixed thereto to restrain the fastener 67 within the confines of the composite aperture formed by the semicircular or grooved jaw fronts.

The operation of any automatic fastener machine is such that the fastener 67 is directed and positioned by the feed mechanism below the punch tool. (See fastener 30 of FIG. 3).

The advantage of this registration system is that a prior art fastener machine has to be slightly modified to accomplish the wide advantages of registration.

The front fastener member 67, as directed by the feed system of the fastener machine, automatically positions the fastener 67 on the fastening machine table 74 at a predetermined location. With the registration apparatus at this position, on the table 74 is positioned a rotatable disc 80, which has a rubber ring or other type of friction bearing surface 81 on a portion of the surface of the disc 80.

The disc 80 is rotated by means of a drive shaft 82 coupled to a high speed, low torque D.C. motor 84.

The drive shaft 82 may comprise two sections as 85 and 86 coupled together by a groove and a flange to permit the shaft to move in directions shown by arrow 83. This is one of a number of coupling techniques which can be used and is necessary to enable the punch associated with the fastener machine to perform the emplacement without damaging the shaft 82.

A spring 87 is used to bias the shaft 82 and to absorb punch forces as well as assuring proper orientation of the apparatus.

Without specifying the control of the D.C. motor 84, the operation of registration will be explained.

A machine operator can select any desired registration system as indicated in FIG. 4A,B,C, or D by advancing one of the set screws as 63 to 66.

In the example shown, the set screw 63 is advanced to protude beneath the bottom surface of the jaw 61.

This will comply with the orientation as shown in FIG. 4D. If only set screw 64 were advanced; orientation, as shown in FIG. 4A, would be provided. Similarly, set screw 65 corresponds to orientation as shown in FIG. 4C and set screw 66 corresponds with registration or orientation as shown in FIG. 4B.

It is noted that only one set screw 63 to 66 is advanced below a surface of a jaw 60 and 61, and all others are retracted as 66 of FIG. 5B.

While set screws are shown to implement the apparatus, it is understood that any finger-like projection will suffice and the set screws can be replaced by solenoid selectors and hence be electrically operated by the depression of an energize button. A solenoid operated scheme also has the advantage that it can be deactivated electrically while further assuring that only one finger will protrude beneath the jaw at any one time; as will be explained.

As previously indicated, the front fastener 67, as directed to the disc 80, is not oriented in any particular manner by conventionally attaching machines. Therefore, as shown in FIG. 5A, the notch 68 can appear during the feed process in any position with respect to the desired orientation.

In any event, the D.C. motor 84 operates at high speed and low torque, which speeds may be 300 rpm or greater. Hence, the motor 84 drives the disc 80 a full revolution in one-fifth of a second or less.

Hence, the fastener 37 is rotated until finger or end of the set screw 63 catches the groove 68. Since the jaw 61 accommodating the set screw 63 is spring biased, it moves slightly downward when the aperture or groove 68 appears beneath the extended set screw 63.

The fastener 67 is maintained in this position even though the motor 84 is still driving the shaft. As indicated, the motor 84 is a low torque motor. The spring 72 as biasing the jaw 60 exerts a downward force which completely counteracts the torque of the motor 84.

The surface of the fastener 67 in contact with the disc 80 is relatively smooth and the friction ring 81 is large enough to assure rotation of the fastener 67 during the absence of an external force on the fastener. As soon as the set screw enters the aperture or groove 68, the fastener is held and the disc rotates beneath it, but cannot rotate the fastener 67 any longer.

Hence, the fastener is restrained by the set screw 63 in the desired orientation as shown in FIG. 4D, for this example. If the operator activated the punch associated with the fastener machine, the emplacement of the logo would be correct and always be so for the desired set screw setting.

The jaws are also shown in a dashed-line position above that shown in FIG. 5B. Since the jaws are pivotally mounted on the table 74, they are pushed upwardly, as shown, by the next fastener as 67, which would be automatically inserted on the disc 80, due to normal fastening machine operation.

Figure 6:
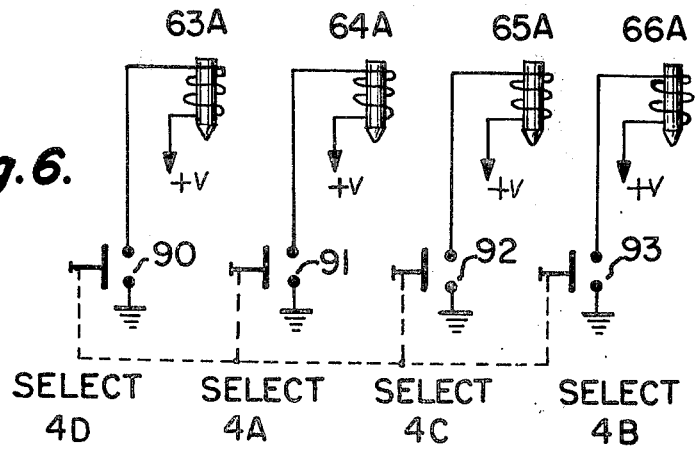
FIG. 6 is a schematic view of an alternate embodiment of a registration selector apparatus.

FIG. 6 shows one of a plurality of schemes for using solenoid finger members in lieu of set screws to provide automatic registration selection by an operator. Each set screw as 63 to 66 of FIG. 5, is replaced with the cylinder of a solenoid as 63A to 66A and positioned within the recesses on the respective jaws 60 and 61 of FIG. 5.

The operator now selects a registration configuration by depressing any one of the four select switches 90 to 93.

The select switches 90 to 93 are mechanically interlocked so that one switch can only be on at any one time. Such switches are commercially available and many suitable types of mechanically or electrically interlocked switch configurations exist.

Hence, if the operator wishes to select the orientation pattern of FIG. 4D, he depresses switch 90 and so on. Only one solenoid is activated due to the interlocked switches.

Other techniques employing semiconductor logic circuits, relays and so on, can be employed as well to provide the same functional operation as indicated.

It should therefor be understood that registration can be accomplished automatically as well as mechanically.

It is understood from the foregoing description that another projection in lieu of a notch can be used, as a tab located on the bottom surface of the front fastener. This is so as registration is performed by the coaction of the notch or tab by the set screw or finger like projection. This action restrains the fastener from rotation, even if the motor is rotating, as the fastener is restrained by coacting with the selected set screw or solenoid cylinder.

Figure 7:
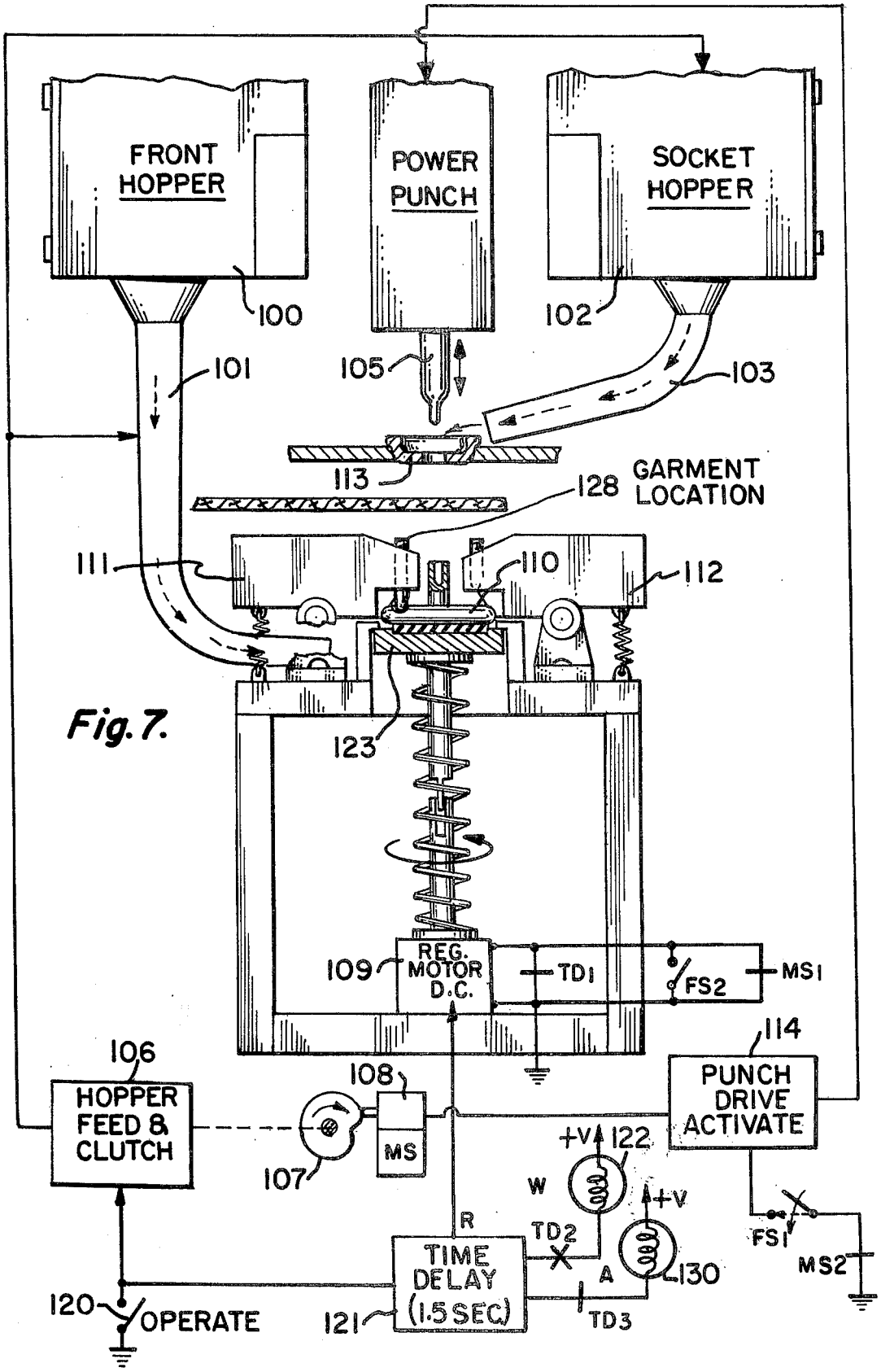
FIG. 7 is a partial block diagram of an automatic attaching machine using a registration system according to this invention.

Referring to FIG. 7, there is shown a partial block diagram of the registration apparatus as utilized in a generic type of automatic snap fastener attaching machine. It is understood that the above described orientation or registration procedure is relatively independent of the basic attaching machine operations and mechanical motions.

There is shown a front hopper 100 which serves to accommodate a large number of front fasteners as that shown in FIG. 1, for example, The hopper 100 is associated with a feed tube or feed conveyor 101. There is also shown a socket hopper 102 which holds a large number of the socket members of the type 23 of FIG. 2B. The socket hopper 102 also has a feed tube or conveyor 103. The hoppers and feed tubes are conventionally controlled by means of a hopper feed assembly 106, which is motor operated and may contain a clutch mechanism to assure that the operator can activate the the punch or die member 105 when both fastener parts are positioned. Shown mechanically coupled to the hopper feed assembly 106 is a cam 107. The cam has a surface configuration such that is activates or closes the module 108 referenced as MS. This module MS is a microswitch which opens or closes when operated by the cam surface. Hence, the cam surface will operate the switch 108 in the position shown and not during any other position about the cam's periphery. When the cam 107 is in the position shown, a short appears across the windings of the D.C. registration motor 109 due to the contact designated as MS1 and hence the registration motor cannot operate. As seen from the FIGURE, a front fastener 110 properly registered is between the two registration jaws 111 and 112. A socket member 113 is also positioned properly.

The operator can now depress the foot switch FS1 and operate the PUNCH DRIVE activate 114 which moves the punch die 105 to emplace the registered fastener on a garment inserted between members 113 and 110, as described above.

The above discussion assumed that the fastener was properly registered as, in fact, it will be based on the following operation.

Assume the machine is first activated. The operator will depress the operate switch 120. This automatically energizes a time delay circuit 121, which may be a time delay relay, a monostable multivibrator or some other well known and conventional time delay circuit. As soon as the time delay is activated, the indicator lamp 122 also designated as W, comes on.

The time delay circuit also activates the registration motor 109 which as explained, begins rotation. The hopper feed and clutch drive 106 is operating as is the cam 107 which is now not activating the micro-switch 108.

Hence, a fastener as 110 is introduced on the disc 123, which is rotating. Since the motor 109 operates at high speed, it is immediately registered by coacting with the desired finger-like projection or set screw surface 128 associated with one of the jaws as 111 or 112. At the end of the time delay which is larger then the maximum possible time for registration, the time delay 121 goes back to its quiescent condition. The registration motor is shorted via MS1 and the foot switch FS1 can be activated via MS2. Another light or lamp 130 also comes on indicating the registration and the machine cycle is complete. The operator now steps on the foot switch to make the emplacement. From then on as will be seen, the operation is entirely automatic. Since the registration of the fastener is much faster than the emplacement of fasteners by the snap-fastener machine, the operator can use the machine as quickly and efficiently as was done so in prior art devices with the extra advantage of being able to perform registration.

It is also noted that when the time delay circuit 121 is in the quiescent state, the D.C. registration motor is also shorted to afford further protection.

Figure 8:
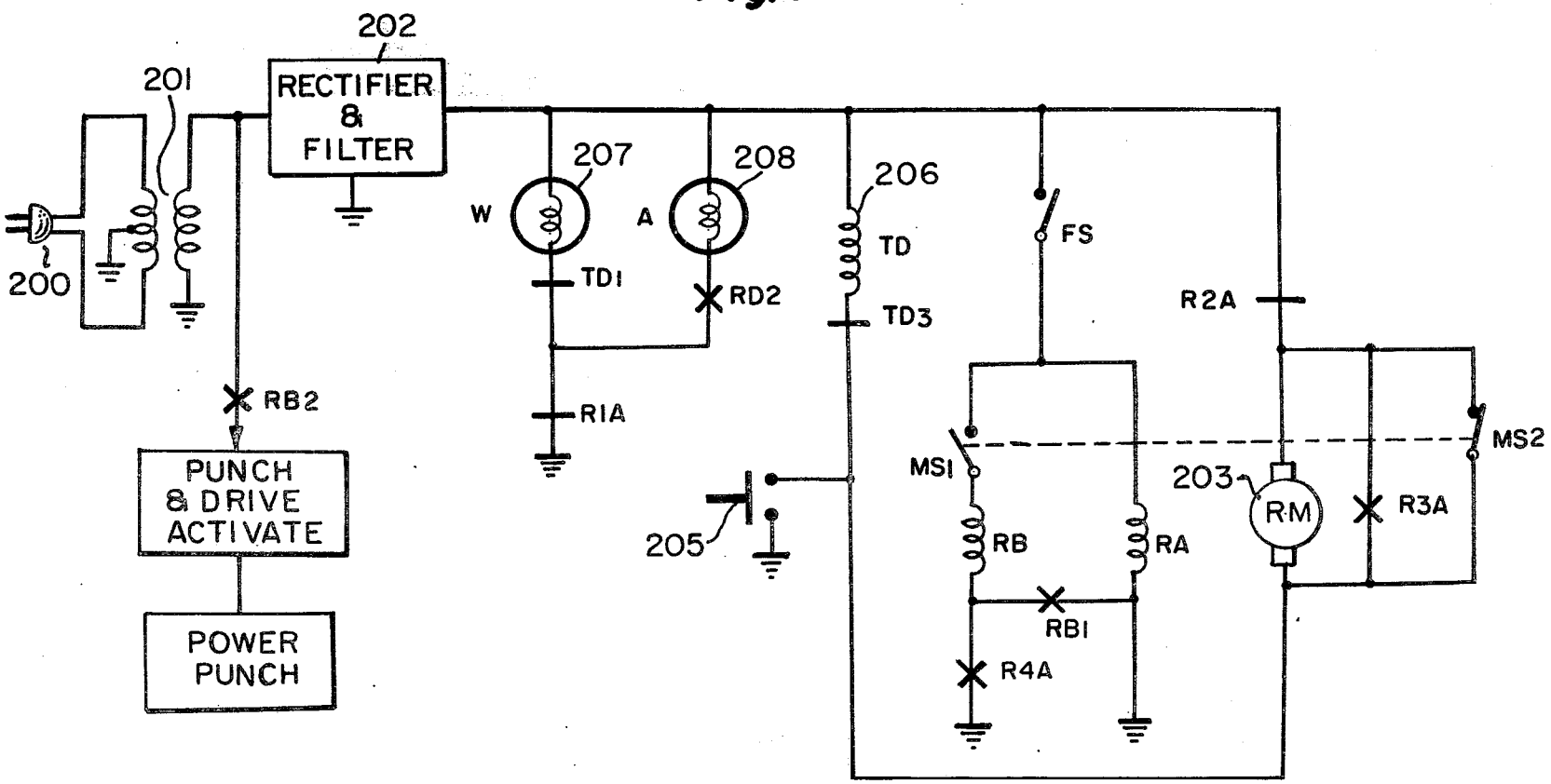
FIG. 8 is a circuit schematic of a control system which can be employed with this invention.

A schematic of a circuit configuration used to control registration will now be explained in conjunction with FIG. 8.

The A.C. line 200 is coupled to an input transformer 201, which may be a voltage step-down transformer to provide a low voltage A.C. signal at the secondary winding.

This signal is conventionally rectified and filtered by means of the rectifier and filter module 202, to provide a low voltage D.C. output signal.

It is seen that the registration motor 203 (RM) has its windings connected across the D.C. source and that the motor windings are shorted by the closed switch designated as MS 2. This is a contact upon the cam activated micro-switch. The contact MS 2 is shown coupled to another contact MS 1 also on the same switch. Hence, as indicated above, when the cam is in the neutral position, the registration motor 203 cannot operate.

This position of the cam specifies the neutral position of the entire machine.

The operator then depresses switch 205 which is the operate switch. The time delay relay 206 is operated via switch 205 and through its own normally closed contact TD 3.

The white light W 207 is on through contact TD 1 and contact RIA of still another relay RA.

The cam has moved off the neutral position and the windings of the registration motor 203 are unshorted as MS 2 is opened. The registration motor operates to register the fastener almost instantaneously as described. The time delay relay 206 is selected to give a delay of 3 to 5 seconds. At the end of the delay, the contact T D, opens and the white light goes off. The amber light 208 is turned on via the contact TD2 which closes at the end of the time delay cycle. As indicated, the amber light coming on indicates to the operator that the foot switch FS can be activated to afford an emplacement of the registered fastener. The time delay relay is also dropped out and deactivated during this time, since the contact TD3 in series with the switch 205 also opens.

The operator now depresses the foot switch FS and activates relay coil RA. A contact R3A across the registration motor again shorts the same even if the microswitch contact MS2 is still opened. This really enables the operator to make emplacements without waiting for the full time delay sequence since, as indicated, registration is much faster than the automatic placement of fasteners by the attaching machine. The contact R1A in series with the lamps 207 and 208 also opens, thus turning off both the white and amber lamps for a depression of the foot switch. Another contact R2A further assures that no power is applied to the motor 203(RM) for the activation of relay RA as power is removed therefrom as well as the short across the windings of the motor by means of contact R3A.

If the microswitch MS1 is not activated by the cam, the relay RB will also activate via contact of the microswitch. When RB operates the contact RB2 closes and permits the emplacement as well as the transport of another fastener by the automatic attaching machine. The contact RB1 connected between the coil terminals of relays RA and RB further assure that RA will operate if RB operates first to prevent a race condition and avoid further problems.

As long as switch 205 is closed, the sequence begins automatically as the time delay begins again.

Thus, the registration and operation is automatic and rapid.

As can be seen, the operator can activate RA and RB by the switch FS even though the time dealy is not complete as long as the microswitch MS1 is closed and MS2 is opened. This is so as the contact R3A and R2A will always assure that the registration motor 203 is stopped when RA is operated.

There are of course, numerous ways of implementing the control logic to activate and stop the registration motor so that the front fastener is registered and stopped before emplacement takes place. Since the D.C. motor 203 operates to drive the registration disc at high speeds, the entire registration operation is many times faster than conventional attaching machine operation.

Many modifications of the apparatus will become apparent to those skilled in the art upon reading this specification and it is understood that any type of fastener machine can be adapted to accommodate a system of the type described. Accordingly, the invention is to be determined by the scope and breadth of the claims herein.

We claim:

1. A method of registering a fastener containing a given logo on a surface prior to the emplacement of the same on a garment, said fastener including indicator means located on a surface thereof indicative of the orientation of said logo with respect to any one of a desired number of preferred orientations, comprising the steps of:

a. placing said fastener on a rotatable emplacement table in any one of a plurality of arbitrary positions,
b. rotating said table at a relatively high speed to cause said fastener to rotate solely about its axis,
c. selecting any one of a plurality of projections located about the rotational path, each adapted to coact with said indicator means, to restrain said fastener in a desired position determined by said selected projection,
d. coacting said indicator means with said projection when said fastener is at said desired position during rotation of the same,
e. ceasing rotation of said fastener when said indicator means is coacted,
f. emplacing said fastener on said garment when said rotation is ceased and therefore when said indicator means is coacted.

2. The method according to claim 1 wherein said plurality of projections comprise four selectable projections located about the periphery of a circle at 90° intervals about said rotational path.

3. A method of registering a fastener containing a given logo on a surface prior to the emplacement of the same on a garment, said fastener including indicator means located on a surface thereof indicative of the orientation of said logo with respect to any one of a desired number of preferred orientations, comprising time steps of:

a. positioning a plurality of selectable members about the periphery of a circle manifesting an emplacement area,
b. placing said fastener relatively at the center of said circle,
c. selecting one of said members indicative of a preferred orientation of said fastener logo with respect to said indicator means,
d. rotating said fastener about its axis to cause fastener to rotate to said preferred orientation according to said selected member, by coacting said fastener with said selected member during rotation,
e. ceasing rotation when said fastener is at said preferred orientation, and
f. emplacing said fastener on said garment when said rotation is ceased.

4. The method according to claim 3 wherein the step of rotating said fastener further comprises placing said fastener on a rotatable table in any one of a plurality of positions and rotating said table at a relatively high speed.

5. The method according to claim 3 wherein said fastener is rotated at a speed of relatively three hundred revolutions per minute.

6. The method according to claim 3 wherein said plurality of projections comprise four selectable projections located at ninety degree intervals about said circle.

7. The method according to claim 3 wherein said fastener is a male fastener part having a central shaft extending from a surface opposite to said logo bearing surface.

8. The method according to claim 7 further including the step of positioning a female part member above said male fastener part prior to the step of emplaceing said fastener on said garment, and said female part member onto said shaft member with said garment positioned between the respective parts.

9. A method of registering a logo on a fastener prior to emplacement of the same on a garment, said fastener of the type having a logo bearing surface and means located on said fastener indicative of the orientation of said logo with respect to any one of a desired number of preferred orientations indicative of enabling one to correctly view said logo when said fastener is emplaced on a garment, comprising the steps of:

a. placing said fastener on a rotatable emplacement area,
b. selecting a desired one of a plurality of moveable members each indicative of a preferred fastener orientation as according to said means on said fastener indicative of the orientation of said logo,
c. rotating said fastener solely about its axis after placement by rotation of said emplacement area,
d. moving said selected member to restrain rotation of said fastener when said fastener is at said one preferred orientation determined solely by the selection of said selected member,
e. ceasing rotation of said emplacement area when said fastener assumes said preferred orientation after restraining of the same, and
f. emplacing said fastener on said garment when said rotation is ceased.

* * * * *